US006475357B2

(12) United States Patent
Lakshmikanthan et al.

(10) Patent No.: US 6,475,357 B2
(45) Date of Patent: Nov. 5, 2002

(54) INFLATABLE COMPLIANT BLADDER ASSEMBLY

(75) Inventors: Jayant Lakshmikanthan, Mountain View; Joe Stevens, San Jose, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/820,426

(22) Filed: Mar. 28, 2001

(65) Prior Publication Data

US 2002/0027071 A1 Mar. 7, 2002

Related U.S. Application Data

(63) Continuation of application No. 09/201,796, filed on Nov. 30, 1998, now Pat. No. 6,228,233.

(51) Int. Cl.[7] ..... C25D 17/00

(52) U.S. Cl. ..... 204/224 R; 204/297.01; 204/297.14

(58) Field of Search ..... 204/224 R, 297.01, 204/279, 297.14

(56) References Cited

U.S. PATENT DOCUMENTS 5,429,733 A * 7/1995 Ishida ..... 204/224 R
5,447,615 A * 9/1995 Ishida ..... 204/224 R
6,080,050 A 6/2000 Chen et al. ..... 451/288

* cited by examiner

*Primary Examiner*—Nam Nguyen
*Assistant Examiner*—Thomas H. Parsons
(74) *Attorney, Agent, or Firm*—Moser, Patterson & Sheridan

(57) ABSTRACT

The present invention provides a bladder assembly for use in an electroplating cell. The bladder assembly comprises a mounting plate, a bladder, and an annular manifold. One or more inlets are formed in the mounting plate and are coupled to a fluid source. The manifold is adapted to be received in a recess formed in the lower face of the mounting plate and secures the bladder thereto. Outlets formed in the manifold communicate with the inlets to route a fluid from the fluid source into the bladder to inflate the same. A substrate disposed on a contact ring opposite the bladder is thereby selectively biased toward a seating surface of the contact ring. A pumping system 159 coupled at the backside of the substrate 121 provides a pressure or vacuum condition.

27 Claims, 5 Drawing Sheets

INFLATABLE COMPLIANT BLADDER ASSEMBLY

This is a continuation of application Ser. No. 09/201,796 filed on Nov. 30, 1998 now U.S. Pat. No. 6,228,233.

BACKGROUND OF THE INVENTION

1. Field of the Invention

The present invention generally relates to deposition of a metal layer onto a substrate. More particularly, the present invention relates to an apparatus and method used in electroplating a metal layer onto a substrate.

2. Description of the Related Art

Sub-quarter micron, multi-level metallization is one of the key technologies for the next generation of ultra large scale integration (ULSI). The multilevel interconnects that lie at the heart of this technology require planarization of interconnect features formed in high aspect ratio apertures, including contacts, vias, lines and other features. Reliable formation of these interconnect features is very important to the success of ULSI and to the continued effort to increase circuit density and quality on individual substrates and die.

As circuit densities increase, the widths of vias, contacts and other features decrease to less than 250 nanometers, whereas the thickness of the dielectric layers remains substantially constant, with the result that the aspect ratios for the features, i.e., their height divided by width, increases. Additionally, as the feature widths decrease, the device current remains constant or increases, which results in an increased current density in the feature. Many traditional deposition processes, such as physical vapor deposition (PVD) and chemical vapor deposition (CVD), have difficulty filling structures where the aspect ratio exceed 4:1, and particularly where it exceeds 10:1.

As a result of process limitations, plating, which had previously been limited to the fabrication of lines on circuit boards, is emerging as a new process of choice to fill vias and contacts on semiconductor devices. Metal electroplating is generally known and can be achieved by a variety of techniques. Present designs of cells for electroplating a metal on a substrate are based on a fountain plater configuration.

FIG. 1 is a cross sectional view of a simplified typical fountain plater 10 incorporating contact pins. Generally, the fountain plater 10 includes an electrolyte container 12 having a top opening, a substrate holder 14 disposed above the electrolyte container 12, an anode 16 disposed at a bottom portion of the electrolyte container 12 and a contact ring 20 contacting the substrate 22. A plurality of grooves 24 are formed in the lower surface of the substrate holder 14. A vacuum pump (not shown) is coupled to the substrate holder 14 and communicates with the grooves 24 to create a vacuum condition capable of securing the substrate 22 to the substrate holder 14 during processing. The contact ring 20 comprises a plurality of metallic or semi-metallic contact pins 26 distributed about the peripheral portion of the substrate 22 to define a central substrate plating surface. The plurality of contact pins 26 extend radially inwardly over a narrow perimeter portion of the substrate 22 and contact a conductive seed layer of the substrate 22 at the tips of the contact pins 26. A power supply (not shown) is attached to the pins 26 thereby providing an electrical bias to the substrate 22. The substrate 22 is positioned above the cylindrical electrolyte container 12 and electrolyte flow impinges perpendicularly on the substrate plating surface during operation of the cell 10.

While present day electroplating cells, such as the one shown in FIG. 1, achieve acceptable results on larger scale substrates, a number of obstacles impair consistent reliable electroplating onto substrates having micron-sized, high aspect ratio features. Generally, these obstacles include providing uniform power distribution and current density across the substrate plating surface to form a metal layer having uniform thickness, preventing backside deposition and contamination, and selecting a vacuum or pressure condition at the substrate backside.

Repeatable uniform contact resistance between the contact pins and the seed layer on a particular substrate as well as from one substrate to the next is critical to achieving overall deposition uniformity. The deposition rate and quality are directly related to current flow. A tenuous pin/seed layer contact restricts current flow resulting in lower deposition rates or unrepeatable results. Conversely, a firm pin/seed layer contact can improve repeatability and reduce contact resistance which will allow increased current flow and superior deposition. Therefore, the variations in contact resistance from pin to pin produces non-uniform plating across the substrate and, consequently, inferior or defective devices.

One attempt to improve power distribution is by increasing the surface area of the contact pins to cover a larger portion of the substrate. However, high points on the substrate abut portions of the plating cell, such as the substrate holder 14 and contact ring 20 shown in FIG. 1, and skew the substrate leading to contact differentials from pin to pin on each substrate. Because contact pins are typically made of a rigid material, such as copper plated stainless steel, platinum, or copper, they do not accommodate the contact height differentials. Skewing may be further exacerbated by the irregularities and rigidity of the substrate holder 14 which supplies the contact force. Thus, adjustments to the geometry of the pins do not remedy the problems associated with topographical irregularities on the backside of the substrate or the substrate holder 14.

Current flow is further affected by the oxidation of the contact pins 26. The formation of an oxide layer on the contact pins 26 acts as a dielectric to restrict current flow. Overtime the oxide layer reaches an unacceptable level requiring cleaning of the contact pins 26. Attempts to minimize oxidation have been made by constructing the contact pins 26 of a material resistant to oxidation such as copper or gold. However, although slowing the process, oxidation layers still formed on the contact pins 26 resulting in poor and inconsistent plating.

Another problem created by the substrate's backside topographical irregularities is failure of the vacuum condition between the substrate holder and the substrate. A hermetic seal at the perimeter of the substrate's backside is critical to ensuring the vacuum condition. Current technology employs the use of vacuum plates such as the substrate holder 14 shown in FIG. 1. However, the rigidity of the substrate holder 14 and the substrate 22 prevents a perfectly flush interface between the two components resulting in leaks. Leaks compromise the vacuum and require constant pumping to maintain the substrate 22 secured against the substrate holder 14. These problems may also be exacerbated by the irregularities of the hardware such as the substrate holder 14 and the contact pins 26.

The cell 10 in FIG. 1 also suffers from the problem of backside plating. Because the contact pins 26 only shield a small portion of the substrate surface area, the electrolyte is able to communicate with the backside of the substrate 22 and deposit thereon. The problem is exacerbated by seal failure between the substrate holder 14 and the substrate 22, as discussed above. Leaks in the seal allow the electrolytic solution onto the substrate's backside. Backside plating requires post-plating cleaning to avoid contamination problems upstream and increases the cost of processing.

Therefore, there remains a need for a method and apparatus maintaining a uniform and repeatable contact resistance delivering a uniform electrical power distribution to a substrate surface in an electroplating cell, maintaining a stable and constant vacuum or pressure condition between the substrate holder and the substrate, and preventing backside deposition.

SUMMARY OF THE INVENTION

The invention generally provides an apparatus for use in electro-chemical deposition of a uniform metal layer onto a substrate. More specifically, the invention provides an inflatable bladder assembly which assists in achieving repeatable uniform contact resistance between a cathode contact ring and a substrate. The bladder assembly is disposed above the substrate during processing and is in fluid communication with a fluid source. The bladder assembly is inflated to a desired pressure thereby providing a compliant and uniform downward pressure to bring the substrate into contact with the cathode contact ring and may act as a seal to prevent backside deposition. In one embodiment, the bladder comprises a single inlet coupled to the fluid source. In an alternative embodiment, a plurality of fluid inlets are disposed intermittently about the bladder assembly.

In another aspect of the invention, a vacuum chuck and an inflatable seal, are provided for holding a substrate during electro-chemical deposition. The vacuum chuck comprises a mounting plate having a vacuum port formed therein. A pump communicates with the port to create a vacuum condition between the mounting plate and a substrate. The inflatable seal comprises a bladder which conforms to the topographical irregularities of the substrate's backside and ensures a hermetic seal at a perimeter portion of the substrate's backside.

In yet another aspect of the invention, a vacuum chuck and an inflatable seal are provided for holding a substrate during electro-chemical deposition. The inflatable seal comprises a bladder which conforms to the topographical irregularities of the substrate's backside and ensures a hermetic seal at a perimeter portion of the substrate's backside. The vacuum chuck comprises a mounting plate having a vacuum port formed therein. A pump, such as a vacuum ejector, communicates with the port to selectively create a vacuum or pressure condition between a substrate and the mounting plate. The vacuum condition assists in securing the substrate to the mounting plate while the pressure condition affects a bowing of the substrate to improve fluid flow across the substrate plating surface.

In still another aspect of the invention, an inflatable seal is disposed at an upper end of an electrolytic cell. A fluid source coupled to the seal supplies a gas thereto. A barrier to process solution is achieved by inflating the seal at a perimeter portion of a substrate during processing. The barrier prevents fluid deposition onto the backside of the seal.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
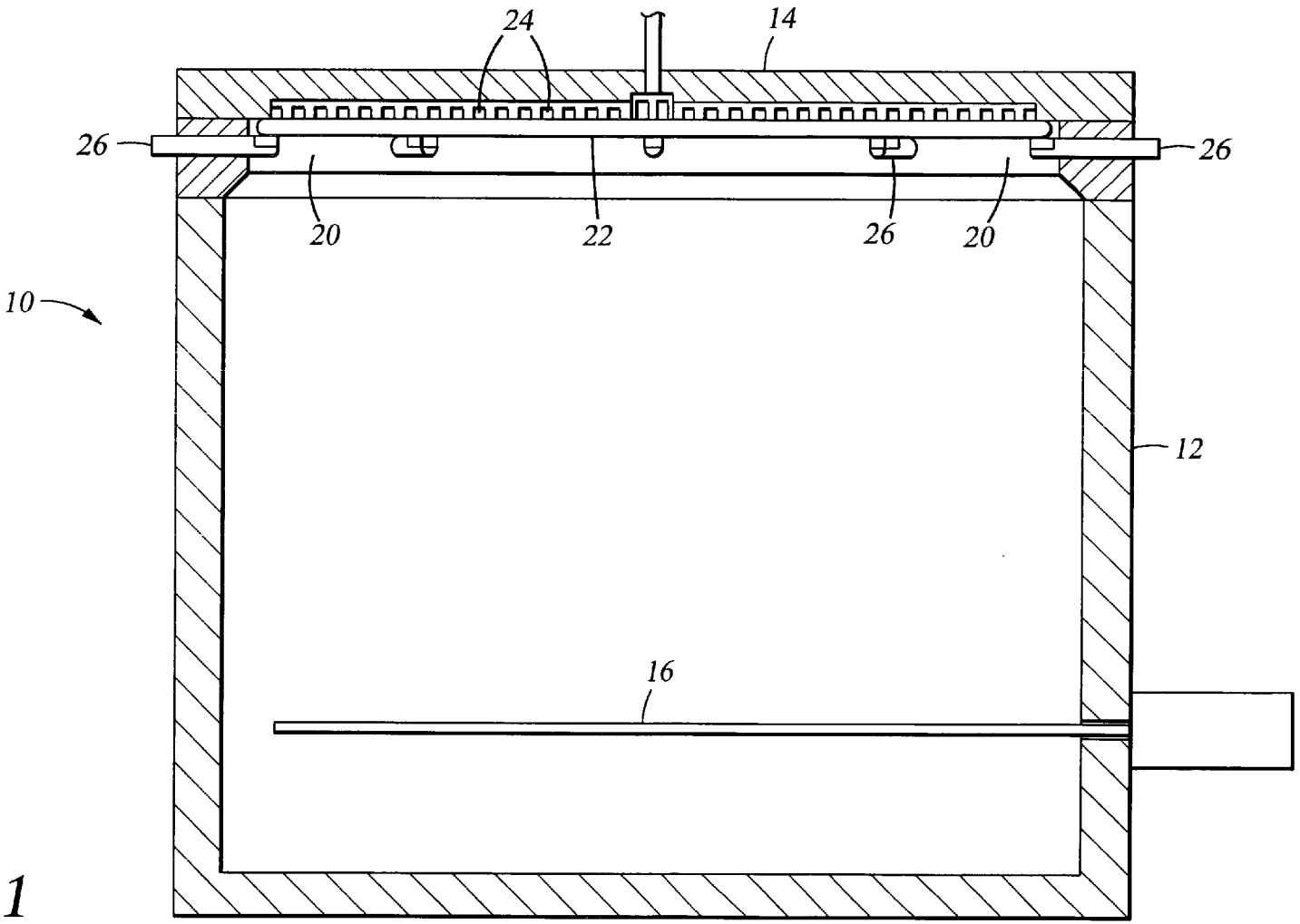
Fig. 1 (PRIOR ART)
FIG. 1 is a cross sectional view of a simplified typical fountain plater of earlier attempts, labeled as prior art.
Figure 2A:
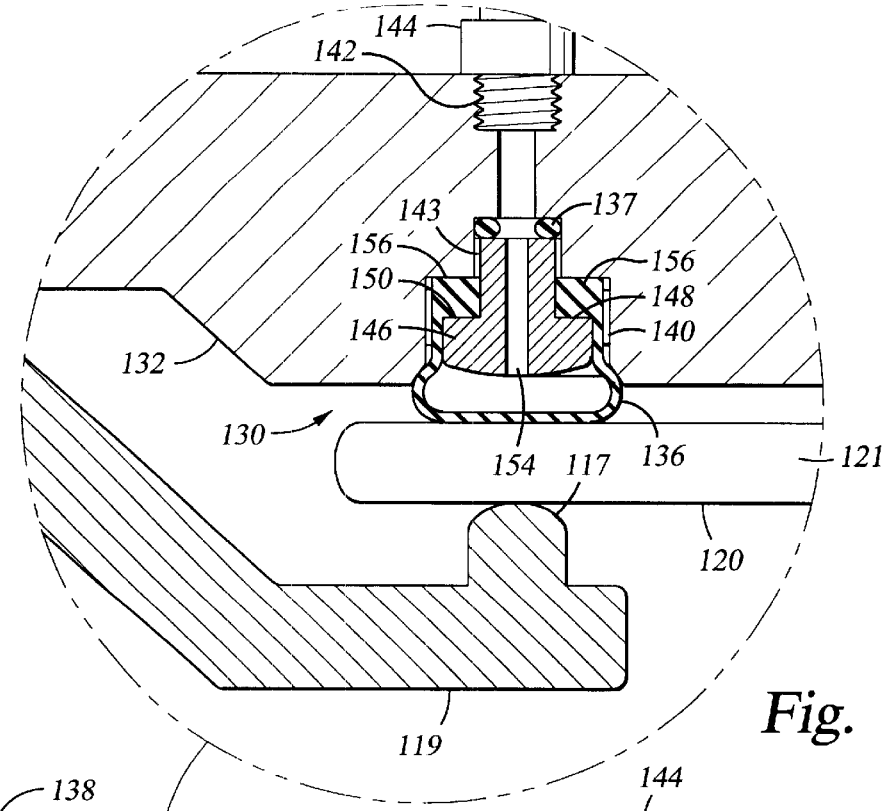
FIG. 2A is an enlarged cross sectional view of the bladder area of FIG. 2.
Figure 2:
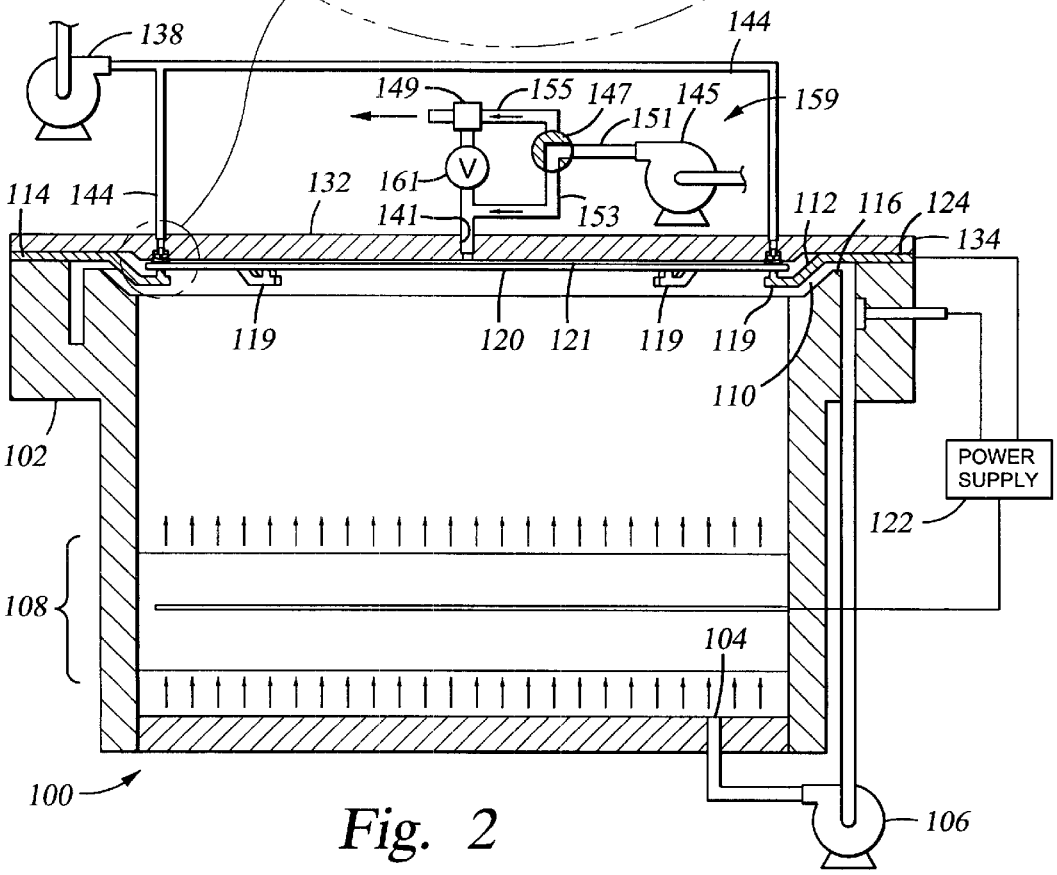
FIG. 2 is a partial cut-away perspective view of an electro-chemical deposition cell of one embodiment of the present invention, showing the interior components of the electro-chemical deposition cell.

FIG. 2 is a partial vertical cross sectional schematic view of an exemplary fountain plater cell 100 for electroplating a metal onto a substrate. The cell 100 is merely illustrative for purposes of describing the present invention. Other cell designs may incorporate and use to advantage the present invention. The electroplating cell 100 generally comprises a container body 102 having an opening on the top portion thereof. The container body 102 is preferably made of an electrically insulative material such as a plastic which does not break down in the presence of plating solutions. The container body 102 is preferably sized and shaped cylindrically in order to accommodate a generally circular substrate at one end thereof. However, other shapes can be used as well. As shown in FIG. 2, an electroplating solution inlet 104 is disposed at the bottom portion of the container body 102. A suitable pump 106 is connected to the inlet 104 to supply/recirculate the electroplating solution (or electrolyte) into the container body 102 during processing. In one aspect, an anode 108 is disposed in the container body 102 to provide a metal source in the electrolyte. The container body 102 includes an egress gap 110 bounded at an upper limit by a shoulder 112 of a cathode contact ring 114 and leading to an annular weir 116. The weir 116 has an upper surface at substantially the same level (or slightly above) a seating surface 117 of a plurality of conducting pins 119 of the cathode contact ring 114. The weir 116 is positioned to ensure that a substrate plating surface 120 of a substrate 121 is in contact with the electrolyte when the electrolyte is flowing out of the electrolyte egress gap 110 and over the weir 116. Alternatively, the upper surface of the weir 116 is positioned slightly lower than the seating surface 117 such that the plating surface 120 is positioned just above the electrolyte when the electrolyte overflows the weir 116, and the electrolyte contacts the substrate plating surface 120 through meniscus properties (i.e., capillary force).

The cathode contact ring 114 is shown disposed at an upper portion of the container body 102. A power supply 122 is connected to a flange 124 to provide power to the pins 119 which define the diameter of the substrate plating surface 120. The shoulder 112 is sloped so that the upper substrate seating surface of the pins 119 is located below the weir 116 or are at least positionable at a position where the substrate plating surface 120 will be in contact with electrolyte as electrolyte flows over the weir 116. Additionally, the shoulder 112 facilitates centering the substrate 121 relative to the conducting pins 119.

An inflatable bladder assembly 130 is disposed at an upper end of the container body 102 above the cathode contact ring 114. A mounting plate 132 having the annular flange 134 is seated on an upper rim of the container body 102. A bladder 136 disposed on a lower surface of the mounting plate 132 is thus located opposite and adjacent to the pins 119 with the substrate 121 interposed therebetween. A fluid source 138 supplies a fluid, i.e., a gas or liquid, to the bladder 136 allowing the bladder 136 to be inflated to varying degrees.

Figure 3:
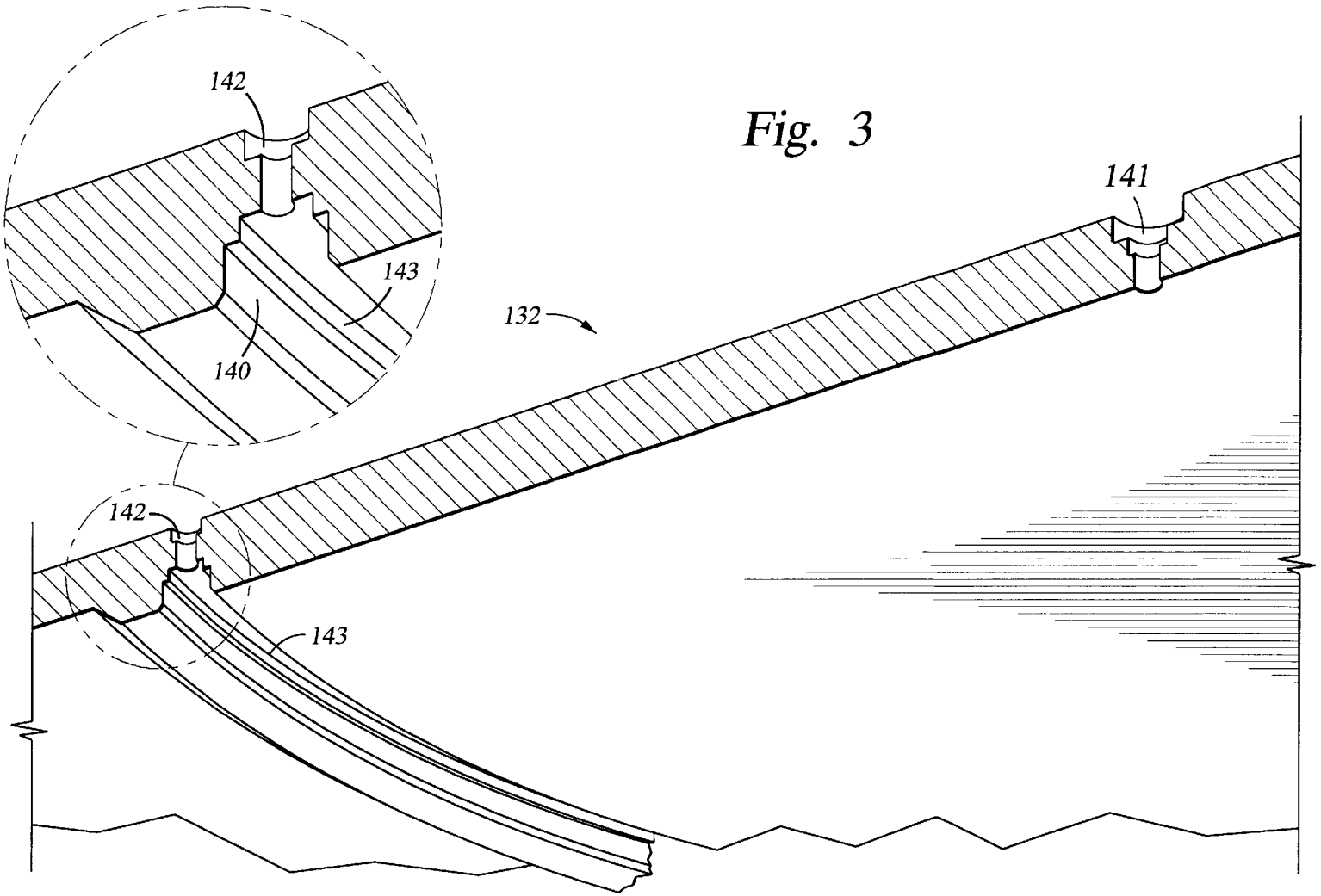
FIG. 3 is a partial cross section of a mounting plate.

Referring now to FIGS. 2, 2A, and 3, the details of the bladder assembly 130 will be discussed. The mounting plate 132 is shown as substantially disc-shaped having an annular recess 140 formed on a lower surface and a centrally disposed vacuum port 141. One or more inlets 142 are formed in the mounting plate 132 and lead into the relatively enlarged annular mounting channel 143 and the annular recess 140. Quick-disconnect hoses 144 couple the fluid source 138 to the inlets 142 to provide a fluid thereto. The vacuum port 141 is preferably attached to a vacuum/pressure pumping system 159 adapted to selectively supply a pressure or create a vacuum at a backside of the substrate 121. The pumping system 159, shown in FIG. 2, comprises a pump 145, a cross-over valve 147, and a vacuum ejector 149 (commonly known as a venturi). One vacuum ejector that may be used to advantage in the present invention is available from SMC Pneumatics, Inc., of Indianapolis, Indiana. The pump 145 may be a commercially available compressed gas source and is coupled to one end of a hose 151, the other end of the hose 151 being coupled to the vacuum port 141. The hose 151 is split into a pressure line 153 and a vacuum line 155 having the vacuum ejector 149 disposed therein. Fluid flow is controlled by the cross-over valve 147 which selectively switches communication with the pump 145 between the pressure line 153 and the vacuum line 155. Preferably, the cross-over valve has an OFF setting whereby fluid is restricted from flowing in either direction through hose 151. A shut-off valve 161 disposed in hose 151 prevents fluid from flowing from pressure line 155 upstream through the vacuum ejector 149. The desired direction of fluid flow is indicated by arrows.

Persons skilled in the art will readily appreciate other arrangements which do not depart from the spirit and scope of the present invention. For example, where the fluid source 138 is a gas supply it may be coupled to hose 151 thereby eliminating the need for a separate compressed gas supply, i.e., pump 145. Further, a separate gas supply and vacuum pump may supply the backside pressure and vacuum conditions. While it is preferable to allow for both a backside pressure as well as a backside vacuum, a simplified embodiment may comprise a pump capable of supplying only a backside vacuum. However, as will be explained below, deposition uniformity may be improved where a backside pressure is provided during processing. Therefore, an arrangement such as the one described above including a vacuum ejector and a cross-over valve is preferred.

Figure 4:
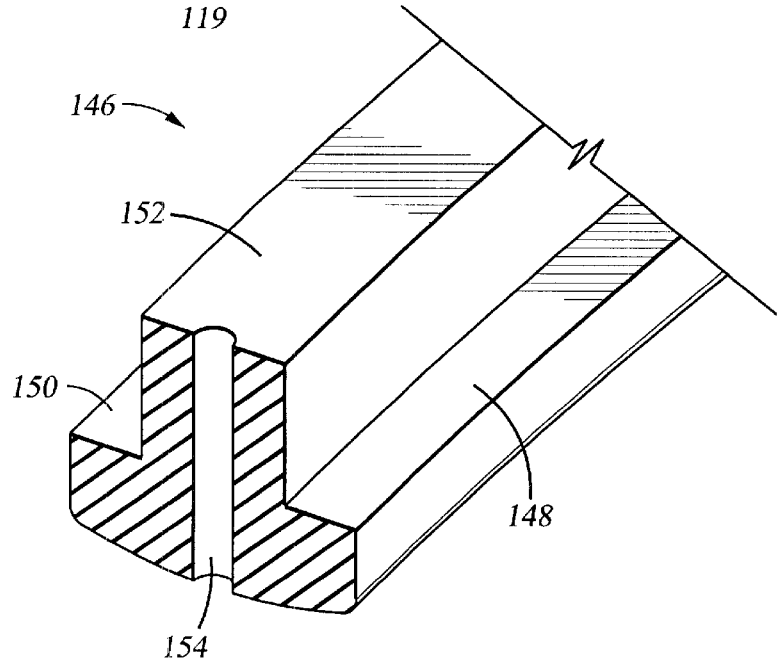
FIG. 4 is a partial cross section of a manifold.

Referring now to FIGS. 2A and 4, a substantially circular ring-shaped manifold 146 is disposed in the annular recess 140. The manifold 146 comprises a mounting rail 152 disposed between an inner shoulder 148 and an outer shoulder 150. The mounting rail 152 is adapted to be at least partially inserted into the annular mounting channel 143. A plurality of fluid outlets 154 formed in the manifold 146 provide communication between the inlets 142 and the bladder 136. Seals 137, such as O-rings, are disposed in the annular manifold channel 143 in alignment with the inlet 142 and outlet 154 and secured by the mounting plate 132 to ensure an airtight seal. Conventional fasteners (not shown) such as screws may be used to secure the manifold 146 to the mounting plate 132 via cooperating threaded bores (not shown) formed in the manifold 146 and the mounting plate 132.

Figure 5:
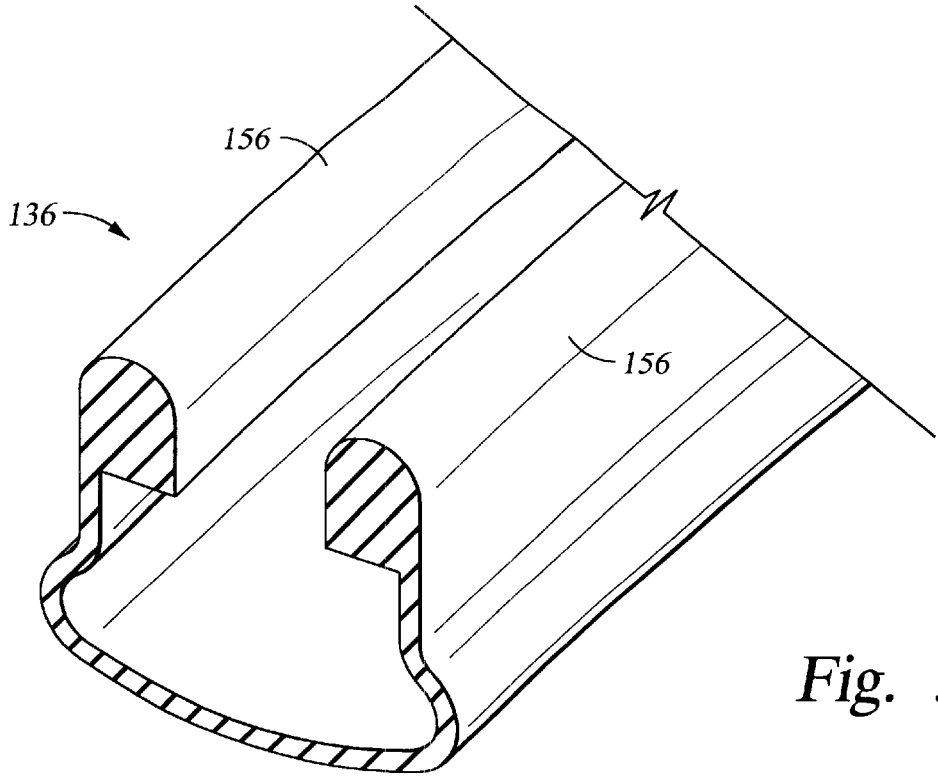
FIG. 5 is a partial cross section of a bladder.
Figure 6:
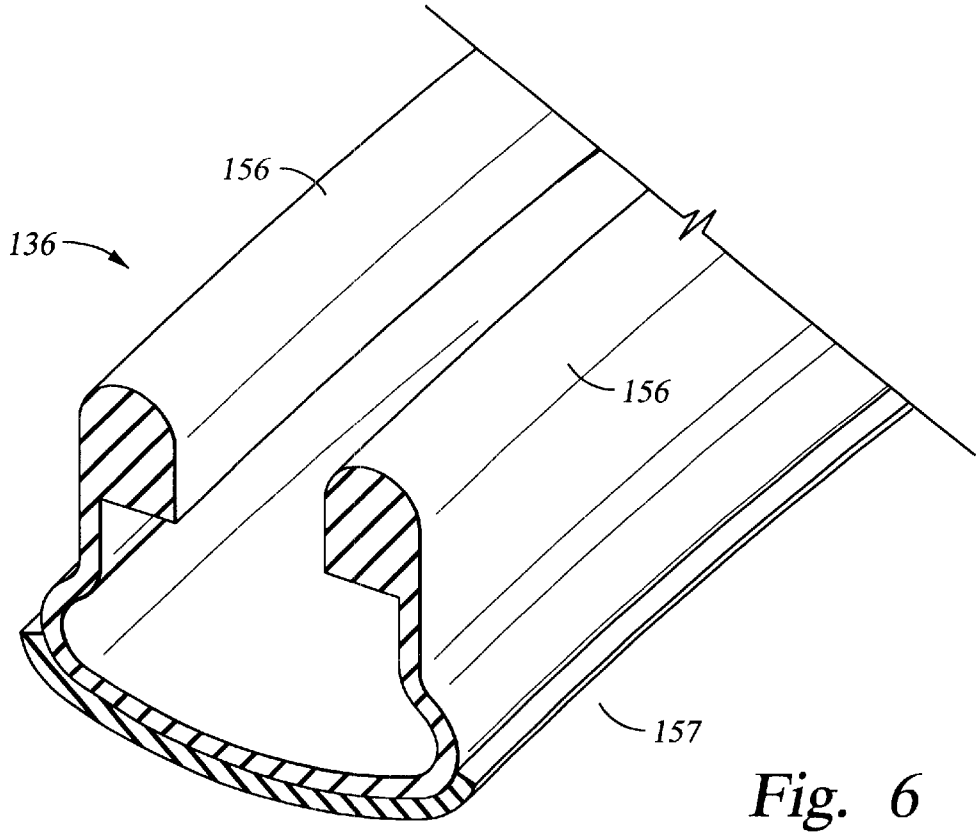
FIG. 6 is a partial cross section of the bladder of FIG. 5 and a cover secured thereto.

Referring now to FIG. 5, the bladder 136 is shown, in section, as an elongated substantially semi-tubular piece of material having annular lip seals 156, or nodules, at each edge. In FIG. 2A, the lip seals 156 are shown disposed on the inner shoulder 148 and the outer shoulder 150. A portion of the bladder 136 is compressed against the walls of the annular recess 140 by the manifold 146 which has a width slightly less (e.g. a few millimeters) than the annular recess 140. Thus, the manifold 146, the bladder 136, and the annular recess 140 cooperate to form a fluid-tight seal. To prevent fluid loss, the bladder 136 is preferably comprised of some fluid impervious material such as silicon rubber or any comparable elastomer which is chemically inert with respect to the electrolyte and exhibits reliable elasticity. Where needed, a compliant covering 157 may be disposed over the bladder 136, as shown in FIG. 6, and secured by means of an adhesive or thermal bonding. The covering 157 preferably comprises an elastomer such as Viton™, buna rubber or the like, which may be reinforced by Kevlare™, for example. In one embodiment, the covering 157 and the bladder 136 comprise the same material. The covering 157 has particular application where the bladder 136 is liable to rupturing. Alternatively, the bladder 136 thickness may simply be increased during its manufacturing to reduce the likelihood of puncture.

The precise number of inlets 142 and outlets 154 may be varied according to the particular application without deviating from the present invention. For example, while FIG. 2 shows two inlets with corresponding outlets, an alternative embodiment could employ a single fluid inlet which supplies fluid to the bladder 136.

In operation, substrate 121 is introduced into the container body 102 by securing it to the lower side of the mounting plate 132. This is accomplished by engaging the pumping system 159 to evacuate the space between the substrate 121 and the mounting plate 132 via port 141 thereby creating a vacuum condition. The bladder 136 is then inflated by supplying a fluid such as air or water from the fluid source 138 to the inlets 142. The fluid is delivered into the bladder 136 via the manifold outlets 154, thereby pressing the substrate 121 uniformly against the contact pins 119. An electrolyte is then pumped into the cell 100 by the pump 106 and flows upwardly inside the container body 102 toward the substrate 121 to contact the exposed substrate plating surface 120. The power supply 122 provides a negative bias to the substrate plating surface 120 via the contact pins. As the electrolyte is flowed across the substrate plating surface 120, ions in the electrolytic solution are attracted to the surface 120. The ions then deposit on the surface 120 to form the desired film.

Because of its flexibility, the bladder 136 deforms to accommodate the asperities of the substrate backside and contact pins 119 thereby mitigating misalignment with the conducting pins 119. The compliant bladder 136 prevents the electrolyte from contaminating the backside of the substrate 121 by establishing a fluid tight seal at a perimeter portion of a backside of the substrate 121. Once inflated, a uniform pressure is delivered downward toward the pins 119 to achieve substantially equal force at all points where the substrate 121 and pins 119 interface. The force can be varied as a function of the pressure supplied by the fluid source 138. Further, the effectiveness of the bladder assembly 130 is not dependent on the configuration of the cathode contact ring 114. For example, while FIG. 2 shows a pin configuration having a plurality of discrete contact points, the cathode contact ring 114 may also be a continuous surface.

Because the force delivered to the substrate 121 by the bladder 136 is variable, adjustments can be made to the current flow supplied by the contact ring 114. As described above, an oxide layer may form on the contact pins 119 and act to restrict current flow. However, increasing the pressure of the bladder 136 may counteract the current flow restriction due to oxidation. As the pressure is increased, the malleable oxide layer is compromised and superior contact between the pins 119 and the substrate 121 results. The effectiveness of the bladder 136 in this capacity may be further improved by altering the geometry of the pins 119. For example, a knife-edge geometry is likely to penetrate the oxide layer more easily than a dull rounded edge or flat edge.

Additionally, the fluid tight seal provided by the inflated bladder 136 allows the pump 145 to maintain a backside vacuum or pressure either selectively or continuously, before, during, and after processing. Generally, however, the pump 145 is run to maintain a vacuum only during the transfer of substrates to and from the electroplating cell 100 because it has been found that the bladder 136 is capable of maintaining the backside vacuum condition during processing without continuous pumping. Thus, while inflating the bladder 136, as described above, the backside vacuum condition is simultaneously relieved by disengaging the pumping system 159, e.g., by selecting an OFF position on the cross-over valve 147. Disengaging the pumping system 159 may be abrupt or comprise a gradual process whereby the vacuum condition is ramped down. Ramping allows for a controlled exchange between the inflating bladder 136 and the simultaneously decreasing backside vacuum condition. This exchange may be controlled manually or by computer.

As described above, continuous backside vacuum pumping while the bladder 136 is inflated is not needed and may actually cause the substrate 120 to buckle or warp leading to undesirable deposition results. It may, however, be desirable to provide a backside pressure to the substrate 120 in order to cause a "bowing" effect of the substrate to be processed. The inventors of the present invention have discovered that bowing results in superior deposition. Thus, pumping system 159 is capable of selectively providing a vacuum or pressure condition to the substrate backside. For a 200 mm wafer a backside pressure up to 5 psi is preferable to bow the substrate. Because substrates typically exhibit some measure of pliability, a backside pressure causes the substrate to bow or assume a convex shape relative to the upward flow of the electrolyte. The degree of bowing is variable according to the pressure supplied by pumping system 159.

Those skilled in the art will readily recognize other embodiments which are contemplated by the present invention. For example, while FIG. 2A shows a preferred bladder 136 having a surface area sufficient to cover a relatively small perimeter portion of the substrate backside at a diameter substantially equal to the contact pins 119, the bladder assembly 130 may be geometrically varied. Thus, the bladder assembly may be constructed using more fluid impervious material to cover an increased surface area of the substrate 121.

Figure 2B:
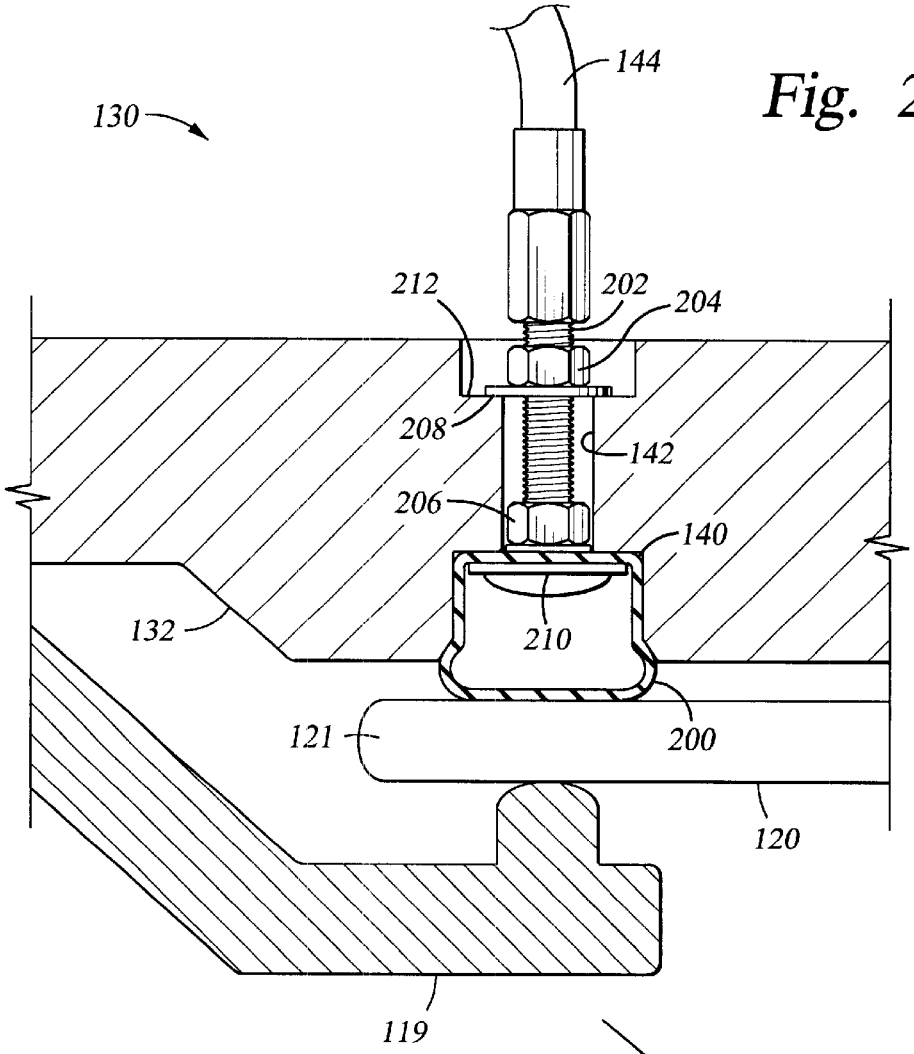
FIG. 2B is an enlarged cross sectional view of the bladder area of FIG. 2 showing an alternative embodiment.

FIG. 2B is another embodiment of the bladder assembly 130 showing a tubular bladder 200 having an externally threaded valve 202 (more than one may also be used to advantage) disposed in the inlet 142 and coupled to the hose 144. The tubular bladder 200 is adjustably secured to the mounting plate 132 by a first nut 204, a second nut 206, and their respective washers. A first washer 208 is seated on a ledge 212 at an upper end of the inlet 142 and a second washer 210 is disposed inside the tubular bladder 200 in substantially parallel relation to the first washer 208. The washers 208, 210 offer counter-active forces to one another which may be increased or decreased by tightening or loosing, respectively, the first nut 204. Alternatively, the tubular bladder 200 may be secured in by an adhesive such as an epoxy or any other permanent or temporary means. This embodiment eliminates the need for the manifold 146 (shown in FIGS. 2A and 4) by employing the use of the valve 202. As a consequence, the mounting plate 132 has been modified to eliminate the annular mounting channel 143.

As noted above, the cell 100 is a typical fountain plater cell wherein a substrate is secured at an upper end. However, other cell designs known in the art employ a mounting plate, or substrate support, disposed at a lower end of a cell such that the electrolyte is flowed from top to bottom. The present invention contemplates such a construction as well as any other construction requiring the advantages of a fluid-tight backside seal to provide a vacuum and/or prevent backside deposition and contamination. Thus, the precise location of the bladder assembly 130 is arbitrary.

The present invention has particular application where pins 119 of varying geometry's are used. It is well known that a constriction resistance, $R_{CR}$, results at the interface of two conductive surfaces, such as between the pins 119 and the substrate plating surface 120, due to asperities between the two surfaces. Generally, as the applied force is increased the apparent contact area is also increased. The apparent area is in turn inversely related to $R_{CR}$ so that an increase in the apparent area results in a decreased $R_{CR}$. Thus, to minimize overall resistance it is preferable to maximize force. The maximum force applied in operation is limited by the yield strength of a substrate which may be damaged under excessive force and resulting pressure. However, because pressure is related to both force and area, the maximum sustainable force is also dependent. on the geometry of the pins 119. Thus, while the pins 119 may have a flat upper surface as in FIG. 2, other shapes may be used to advantage. The pressure supplied by the inflatable bladder 136 may then be adjusted for a particular pin geometry to minimize the constriction resistance without damaging the substrate. A more complete discussion of the relation between contact geometry, force, and resistance is given in *Ney Contact Manual,* by Kenneth E. Pitney, The J. M. Ney Company, 1973, which is hereby incorporated by reference in its entirety.

While foregoing is directed to the preferred embodiment of the present invention, other and further embodiments of the invention may be devised without departing from the basic scope thereof, and the scope thereof is determined by the claims that follow.

What is claimed is:

1. An inflatable bladder assembly for loading a substrate in an electroplating cell, comprising:

a mounting plate having a top surface and a bottom surface; and an inflatable bladder disposed on the bottom surface of the mounting plate, the inflatable bladder having a substrate-receiving surface configured to at least partially contact a perimeter portion of a backside of a substrate.

2. The inflatable bladder assembly of claim 1, wherein the inflatable bladder is adapted to be inflated substantially perpendicular to the backside of the substrate.

3. The inflatable bladder assembly of claim 1, wherein the inflatable bladder is adapted to at least partially contact the edge of the substrate.

4. The inflatable bladder assembly of claim 1, wherein the inflatable bladder has an inner diameter less than the diameter of the substrate.

5. The inflatable bladder assembly of claim 1, wherein the inflatable bladder has an outer diameter greater than the diameter of the substrate.

6. The inflatable bladder assembly of claim 1, wherein the mounting plate is sized and shaped to cover the backside of the substrate.

7. The inflatable bladder assembly of claim 1, further comprising a channel disposed on the mounting plate, wherein the inflatable bladder is at least partially disposed in the channel.

8. The inflatable bladder assembly of claim 1, wherein the inflatable bladder defines a space between the mounting plate and the backside of the substrate.

9. The inflatable bladder assembly of claim 1, wherein the mounting plate comprises a vacuum port.

10. The inflatable bladder assembly of claim 1, wherein the mounting plate comprises a vacuum port disposed centrally thereon.

11. The inflatable bladder assembly of claim 1, wherein the mounting plate comprises a vacuum port connected to a vacuum pumping system.

12. The inflatable bladder assembly of claim 1, wherein the mounting plate comprises a vacuum port connected to a vacuum pumping system adapted to evacuate a space defined between the inflatable bladder, the mounting plate and the substrate.

13. The inflatable bladder assembly of claim 1, wherein the inflatable bladder defines a space between the mounting plate and the backside of the substrate, and wherein the mounting plate comprises a vacuum port connected to a vacuum pumping system adapted to evacuate the space.

14. An apparatus for electroplating a substrate comprising:

an electroplating cell body;

an electrode disposed at a first end of the body;

a contact ring at least partially disposed within the cell body at a second end, the contact ring having contact pins;

a mounting plate having a top surface and a bottom surface, the mounting plate being adapted to move in relation to the contact ring so as to position a substrate adjacent the contact pins; and an inflatable bladder disposed on the bottom surface of the mounting plate, the inflatable bladder having a substrate-receiving surface configured to at least partially contact a perimeter portion of a backside of the substrate.

15. The apparatus of claim 14, wherein the inflatable bladder is positioned opposite the contact pins.

16. The apparatus of claim 14, wherein the inflatable bladder is adapted to at least partially contact the edge of a substrate.

17. The apparatus of claim 14, wherein the inflatable bladder has an inner diameter less than the diameter of the substrate.

18. The apparatus of claim 14, wherein the inflatable bladder has an outer diameter greater than the diameter of the substrate.

19. The apparatus of claim 14, wherein the mounting plate is sized and shaped to cover the backside of the substrate.

20. The apparatus of claim 14, further comprising a channel disposed on the mounting plate opposite the contact pins, wherein the inflatable bladder is at least partially disposed in the channel.

21. The apparatus of claim 14, wherein the mounting plate comprises a vacuum port.

22. The apparatus of claim 14, wherein the mounting plate comprises a vacuum port disposed centrally thereon.

23. The apparatus of claim 14, wherein the mounting plate comprises a vacuum port connected to a vacuum pumping system.

24. The apparatus of claim 14, wherein the mounting plate comprises a vacuum port connected to a vacuum pumping system adapted to evacuate a space defined between the inflatable bladder, the mounting plate and the substrate.

25. The apparatus of claim 14, wherein the inflatable bladder defines a space between the mounting plate and the backside of the substrate.

26. The apparatus of claim 14, wherein the inflatable bladder defines a space between the mounting plate and the backside of the substrate, and wherein the mounting plate comprises a vacuum port connected to a vacuum pumping system adapted to evacuate the space.

27. The apparatus of claim 14, wherein the inflatable bladder is configured to apply pressure across the backside of the substrate so as to allow the substrate to uniformly contact the contact pins.

* * * * *

UNITED STATES PATENT AND TRADEMARK OFFICE

CERTIFICATE OF CORRECTION

PATENT NO. : 6,475,357 B2 
DATED : November 5, 2002
INVENTOR(S) : Lakshmikanthan et al.

It is certified that error appears in the above-identified patent and that said Letters Patent is hereby corrected as shown below:

Column 6,
Line 32, please change "Kevlare™" to -- Kevlar™ --.

Signed and Sealed this

Third Day of August, 2004

JON W. DUDAS
*Acting Director of the United States Patent and Trademark Office*